US006464161B1

(12) United States Patent
Kaipf

(10) Patent No.: US 6,464,161 B1
(45) Date of Patent: Oct. 15, 2002

(54) PROCESS FOR SEVERING A TRAVELING MATERIAL WEB AND DEVICE FOR PERFORMING THE PROCESS

(75) Inventor: Walter Kaipf, Haunsheim (DE)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 0 days.

(21) Appl. No.: 09/419,295

(22) Filed: Oct. 15, 1999

(30) Foreign Application Priority Data

Oct. 22, 1998 (DE) ..... 198 48 808

(51) Int. Cl.[7] ..... B65H 35/08
(52) U.S. Cl. ..... 242/526.3
(58) Field of Search ..... 242/526.3, 526, 242/526.1, 527

(56) References Cited

U.S. PATENT DOCUMENTS

| | | | | |
|---|---|---|---|---|
| 2,278,029 A | | 3/1942 | Walsh et al. | |
| 3,232,739 A | | 2/1966 | Belak | |
| 3,323,739 A | | 6/1967 | Deming | |
| 3,857,524 A | | 12/1974 | Melead et al. | |
| 3,869,095 A | * | 3/1975 | Diltz | 242/326.3 |
| 4,458,852 A | * | 7/1984 | Calvert et al. | 242/326.3 |
| 4,515,321 A | | 5/1985 | Kahlman | |
| 4,546,930 A | * | 10/1985 | Rohde et al. | 242/326.3 |
| 4,695,004 A | * | 9/1987 | Grossmann et al. | 242/326.3 |

FOREIGN PATENT DOCUMENTS

| | | |
|---|---|---|
| DE | 1266601 | 4/1968 |
| DE | 2010072 | 9/1971 |
| DE | 2208968 | 9/1973 |
| DE | 2232338 | 1/1974 |
| DE | 2301193 | 7/1974 |
| DE | 4226418 | 2/1994 |
| DE | 4401804 | 6/1994 |
| DE | 29508732 | 11/1995 |
| DE | 19710281 | 9/1998 |
| EP | 0089595 | 9/1983 |
| WO | 96/11868 | 4/1996 |

* cited by examiner

*Primary Examiner*—William A. Rivera
(74) *Attorney, Agent, or Firm*—Greenblum & Bernstein, P.L.C.

(57) ABSTRACT

Process for severing a traveling material web, at reel spool changeover, in a winding device. The process comprises moving a severing device into the web travel path between a winding roll and an empty reel spool on one side and a reel spool carrying a reel formed on the other side of the device and severing the material web across the width of the material web at several places, sequentially by the severing device, at separation points which lie along a line that runs at an angle to a travel direction of the web. A winding device for a material web, e.g., a paper web, comprises a winding roll, an empty reel spool on one side of the winding roll and a reel spool carrying a reel on another side of the winding roll. A severing device for severing the material web, at reel spool changeover, is moved into the web travel path between the winding roll and the empty reel spool. The material web is severed across the width thereof at several places sequentially by the severing device, at separation points which lie along a line that runs at an angle to the travel direction of the web.

32 Claims, 4 Drawing Sheets

PROCESS FOR SEVERING A TRAVELING MATERIAL WEB AND DEVICE FOR PERFORMING THE PROCESS

CROSS-REFERENCE TO RELATED APPLICATIONS

The present application claims priority under 35 U.S.C. § 119 of German Patent Application No. 198 48 808.4, filed on Oct. 22, 1998, the disclosure of which is expressly incorporated by reference herein in its entirety.

BACKGROUND OF THE INVENTION

1. Field of the Invention

The present invention relates to a process for severing a traveling material web, particularly a paper web in a winding device during reel spool changeover, in which a severing device is moved into the web travel path between a winding roll and an empty reel spool on the one side and the nearly full reel spool on the other side. The invention also relates to a device for performing such a process.

2. Discussion of Background Information

Winding devices of the type related to this invention are used at the end of a machine for manufacturing a material web where they facilitate continuous winding of the material web onto a reel spool. After a reel is finished, which is to say after a desired reel diameter has been reached, the material web must be severed and the full reel spool must be replaced by an empty reel spool, onto which the next reel is wound. On rare occasions, reel spool changeover can even take place when the reel has not yet reached the normally desired diameter.

A process and a device for performing such a reel spool changeover are known from WO 96/11868. To sever the paper web, this device uses a knife blade that traverses the entire width of the web and is moved from a neutral position to the web travel path of the paper web.

SUMMARY OF THE INVENTION

The present invention resides in a process of the type generally discussed above that provides a device for performing such a process.

This process provides a severing device that sequentially severs the material web across the width of the material web at several places so that, relative to the material web, the separation points lie along a line that runs at an angle to the web travel direction.

According to the invention, severing of the material web is performed in such a way that a cut edge results which is angled to the web travel direction. This cut edge can run at the same angle consistently across the entire width of the web. However, the cut edge can also take the form of a V-shape or a zigzag.

Severing the material web sequentially at several places along a line running at an angle to the web travel direction results in an especially advantageous, high-precision cut edge.

Preferably, the new web tail created in this manner is moved toward the empty reel spool by pressurized air. This ensures that the web tail is guided reliably to the empty reel spool.

To perform the process according to the invention, a device is used in one embodiment with a rotationally driven severing roll which moves from a neutral position to a cutting position and back, and which has on its roll sleeve several severing elements arranged along at least one spiral line.

When the severing roll is rotated, the severing elements arranged in a spiral on it engage with the material web one after the other. The circumferential velocity of the severing roll can equal the web travel velocity, but it can also be slower or faster than this velocity.

In addition, it is especially advantageous for the severing roll to be arranged on the side of the material web facing away from the empty reel spool. Thus, the movement of the severing roll between the neutral position and the severing position can take place without interfering with the empty reel spool.

In a further embodiment of the invention, air blast nozzles are provided on the roll. These are designed to aid in guiding the material web onto the empty reel spool. This reduces the risk of faulty guidance of the material web, increasing the reliability of the device correspondingly.

In one embodiment of the invention, the air blast nozzles can each be located directly adjacent to a severing element on the severing roll, and be supplied with pressurized air from the interior of the severing roll. In another embodiment of the invention, however, one or more air blast pipes with air blast nozzles can be provided on the outer surface of the roll sleeve of the severing roll. In this manner, the air volume is kept small, which results in a rapid pressure buildup and has the additional advantage that the air lost to leakage is reduced. The air blast pipes are preferably arranged parallel to the severing elements along a spiral line. Consequently, the pressurized air acts directly on the relevant cut edge.

According to one embodiment of the invention, the spiral line along which the severing elements are arranged on the severing roll can extend continuously across the entire width of the roll. This produces a straight cut edge diagonal to the web travel direction. According to another embodiment of the invention, however, the severing elements can also extend along two spiral lines running outward in opposite directions from a common point in the center of the severing roll. Because of the rotation of the severing roll this design generates a V-shaped cut edge, the peak of which points either in the web travel direction or in the opposite direction, depending on the arrangement of the spiral lines.

According to another embodiment of the invention, the severing elements are arranged along several spiral lines running alternately in opposite directions and connecting with one another across the width of the roll. This design produces a zigzag cut edge, the peaks of which again point either in the web travel direction or in the opposite direction, depending on the arrangement of the spiral lines.

In all cases, the spiral lines can encircle the circumference of the severing roll one or more times. However, it is also possible to arrange the spiral lines such that they encircle only part of the circumference of the severing roll. This arrangement has the advantage that the severing roll can initially be placed against the material web at its region that is free of severing elements. The synchronization of this placement and the rotation of the severing roll is thus simplified.

According to another embodiment of the invention, control structure is provided through which, in sequence, the severing roll can be set to rotate, the air blast nozzles can be supplied with pressurized air, and the severing roll can be moved to its severing position, such that the delivery of pressurized air to the air blast nozzles preferably occurs immediately before the severing roll penetrates the material web. In a corresponding fashion, the process is reversed; the severing roll is moved back to its starting position, the rotation of the severing roll is stopped, and the air supply is shut off. In this way, the severing process can advantageously be automated.

According to another embodiment of the invention, control structure is provided which ensures that the forwardmost severing element when viewed in the rotational direction of the severing roll, is the first to act upon the material web. Thus, the control structure is used to ensure that complete and clean severing takes place across the entire width of the material web.

The process according to the invention can also be performed with a device which has a supporting beam extending essentially across the width of the material web and carrying the severing elements. The severing elements are moveable from a neutral position to a severing position and back, wherein the severing elements are arranged such that they engage the material web one after another when the supporting beam is moved into the severing position. The severing elements are arranged on the supporting beam to produce the desired shape of the cut edge. Thus, the severing elements can be arranged on the supporting beam along a line running continuously across the entire web width at an angle to the web travel direction.

According to another embodiment of the invention, the severing elements on the supporting beam can extend along two lines running outward in opposite directions from a common point in the center of the web. According to yet another embodiment of the invention, the severing elements can be arranged on the supporting beam in a zigzag perpendicular to the web travel direction. Since the severing elements engage with the material web sequentially when the supporting beam is moved from the neutral position to the severing position, the desired shape of the cut edge can be produced in this manner.

According to another embodiment of the invention, the supporting beam is swivel-mounted such that the severing elements act upon the material web one after another starting with the forwardmost severing element in the web travel direction. This design ensures that complete and clean severing takes place across the entire width of the material web.

According to another embodiment of the invention, air blast nozzles are provided on the supporting beam to aid in guiding the material web onto the empty reel spool. In this manner, the material web is blown onto the empty reel spool directly at the cut edge.

The process according to the invention can additionally be performed with a device which has a carrier extending transversely across the web width upon which several severing elements are distributed next to one another across the web width, and which causes the severing elements to act on the material web in time sequenced fashion relative to one another. In this variation, the carrier with the severing elements is brought to a fixed severing position. The production of several separation points across the web width is then accomplished in that the severing elements are activated in sequence by appropriate structure.

Several blades are arranged on the carrier such that they can swivel between a neutral position, in which the blades extend in the web travel direction next to the material web, and a severing position in which the blades cross the web travel path. The desired separation points are provided across the web width through the time-sequenced swiveling of the blades into the web travel path. The shape of the cut edge can be produced as desired through appropriate time sequenced activation of the blades. Hence this variation can also produce a continuous diagonal cut edge, a V-shaped cut edge and a zigzag cut edge.

The blades are activated by a rotationally driven camshaft mounted beneath the blades, where the cams raise or lower the blades as a function of the rotational position of the camshaft.

According to another embodiment of the invention, air blast nozzles are arranged on the carrier. In particular, the air blast nozzles are each located between two severing elements. Again, in this manner, the newly formed web tail is blown directly at the cut edge.

In all variations, blades are provided as severing elements, where the blades can have a straight or a serrated cutting edge. Good severing results can be achieved using blades as severing elements. However, the severing elements can also be laser beams or pressurized water jets, or other severing elements.

There is disclosed herein, a process for severing a traveling material web, at reel spool changeover, in a winding device. The process comprises moving a severing device into the web travel path between a winding roll and an empty reel spool on one side and a reel spool carrying a reel formed on the other side of the device and severing the material web across the width of the material web at several places, sequentially by the severing device, at separation points which lie along a line that runs at an angle to a travel direction of the web.

The material web may comprise a paper web. The line for the separation points runs at substantially the same angle across the entire width of the web. Alternatively, the line runs in the shape of an upside-down V from a center of the web to the edges of the material web. In yet another alternative, the line runs as a zigzag across a width of the web.

The process according to the invention further comprises moving, by way of pressurized air, a new web tail created by the severing process toward the empty reel spool. The severing is performed by moving a rotationally driven severing roll from a neutral position to a cutting position and back, the severing roll having a sleeve on which several severing elements are arranged along at least one spiral line. The rotational velocity of the severing roll is adjusted to be at least approximately equal to the travel velocity of the web.

The severing roll is arranged on a side of the material web facing away from the empty reel spool. The material web is guided onto the empty reel spool by way of blowing air through air blast nozzles provided on the severing roll. Pressurized air is supplied from the interior of the severing roll to the air blast nozzles, each of the blast nozzles being located directly adjacent to a severing element.

The material web is guided onto the empty reel spool by way of blowing air through at least one air blast pipe and air blast nozzles provided on the outer surface of the roll sleeve of the severing roll. The at least one air blast pipe is arranged parallel to the severing elements along a spiral line. Alternatively, the severing elements are arranged along at least one spiral line which extends continuously across substantially the entire width of the severing roll. As a further alternative, the severing elements are arranged along two spiral lines running outwardly in opposite directions from a common point in a center of the severing roll.

The spiral lines encircle only part of the circumference of the severing roll, another part of the circumference of the severing roll being free of severing elements. The severing elements are arranged along several spiral lines running alternately in opposite directions and connecting with one another.

The severing of the web is performed sequentially by rotating the severing roll, delivering pressurized air to the blast nozzles and moving the severing roll to its severing position, wherein delivery of pressurized air to the blast nozzles occurs immediately before the severing roll penetrates the material web.

A controller ensures that a forwardmost severing element of each spiral line, when viewed in the rotational direction of the severing roll, is the first to act upon the material web.

According to another aspect of the invention, a support beam, extending essentially across the width of the material web and carrying the severing elements, is moved from a neutral position to a severing position and back, wherein the severing elements are arranged such that they engage the material web one after another when the supporting beam is moved into the severing position. The supporting beam is arranged on the side of the material web facing away from the empty reel spool.

According to the invention, the severing elements are arranged on the supporting beam along a line running continuously across substantially the entire width of the web at an angle to the web travel direction. Alternatively, the severing elements on the supporting beam extend along two lines running outward in opposite directions from a center of the web. In accordance with a further embodiment, the severing elements on the supporting beam are arranged along a zigzag line running perpendicular to the travel direction of the web.

The supporting beam is swivel-mounted such that the severing elements act upon the material web one after another starting with the forwardmost severing element in the travel direction of the web. Air blast nozzles are provided on the supporting beam.

According to an aspect of the invention, the severing elements are controlled in a manner to have them act on the material web at intervals relative to one another and wherein a carrier extends transversely across the width of the web, the carrier having several severing elements distributed next to one another across the web width. Several blades are arranged on the carrier in a manner permitting them to swivel between a neutral position, in which the blades extend in the travel direction of the web next to the material web, and a severing position in which the blades cross the travel path of the web.

A camshaft mounted beneath the blades is rotationally driven. The blades are raised or lowered as a function of the rotational position of cams on the camshaft. The carrier is arranged on the side of the material web facing away from the empty reel spool. Air blast nozzles are provided on the carrier to aid in guiding the material web onto the empty reel spool.

Air blast nozzles are each located between two severing elements. The severing elements comprise blades which have a straight cutting edge or a serrated cutting edge.

The invention further contemplates a winding device for a material web, e.g., a paper web, comprising a winding roll, an empty reel spool on one side of the winding roll and a reel spool carrying a reel on another side of the winding roll. A severing device for severing the material web, at reel spool changeover, is moved into the web travel path between the winding roll and the empty reel spool. The material web is severed across the width thereof at several places sequentially by the severing device, at separation points which lie along a line that runs at an angle to the travel direction of the web. The line runs at substantially the same angle across the entire width of the web. Alternatively, the line runs in the shape of an upside-down V from a center of the web to the edges of the material web. In a further embodiment, yet, the line runs as a zigzag across a width of the web. A source of pressurized air moves a new web tail created by the severing process toward the empty reel spool.

According to an aspect of the invention, the severing device comprises a rotationally driven severing roll moving from a neutral position to a cutting position and back, the severing roll having a sleeve on which several severing elements are arranged along at least one spiral line. An adjustment mechanism is provided for adjusting the rotational velocity of the severing roll to be at least approximately equal to the travel velocity of the web. The severing roll is arranged on a side of the material web facing away from the empty reel spool.

Air blast nozzles are provided on the severing roll for guiding the material web onto the empty reel spool by blowing air thereon. A pressurized air connection is made from the interior of the severing roll to the air blast nozzles, each of the blast nozzles being located directly adjacent to a severing element.

At least one air blast pipe and air blast nozzles are provided on the outer surface of the roll sleeve of the severing roll for guiding the material web onto the empty reel spool by way of blowing air thereon. At least one air blast pipe is arranged parallel to the severing elements along a spiral line.

According to one embodiment of the invention, the severing elements are arranged along at least one spiral line which extends continuously across substantially the entire width of the severing roll.

According to another embodiment of the invention, the severing elements are arranged along two spiral lines running outwardly in opposite directions from a common point in a center of the severing roll.

According to yet another embodiment of the invention, the severing elements are arranged along several spiral lines running alternately in opposite directions and connecting with one another.

The spiral lines encircle only part of the circumference of the severing roll, another part of the circumference of the severing roll being free of severing elements.

A controller causes sequential rotation of the severing roll, pressurized air delivery to the blast nozzles and movement of the severing roll to its severing position, wherein delivery of pressurized air to the blast nozzles occurs immediately before the severing roll penetrates the material web.

A controller ensures that a forwardmost severing element of each spiral line, when viewed in the rotational direction of the severing roll, is the first to act upon the material web.

A supporting beam extends essentially across the width of the material web and carries the severing elements, from a neutral position to a severing position and back, wherein the severing elements are arranged such that they engage the material web one after another when the supporting beam is moved into the severing position.

The supporting beam is arranged on a side of the material web facing away from the empty reel spool.

The severing elements are arranged on the supporting beam along a line running continuously across substantially the entire width of the web at an angle to the web travel direction. Alternatively, the severing elements on the supporting beam extend along two lines running outward in opposite directions from a center of the web. Further yet, the severing elements on the supporting beam are arranged along a zigzag line running perpendicular to the travel direction of the web.

The supporting beam is swivel-mounted such that the severing elements act upon the material web one after another starting with the forwardmost severing element in the travel direction of the web.

Air blast nozzles are provided on the supporting beam.

A controller is provided for controlling the severing elements in a manner to have them act on the material web at intervals relative to one another. A carrier extends transversely across the width of the web, the carrier having several severing elements distributed next to one another across the web width.

Several blades are arranged on the carrier in a manner permitting them to swivel between a neutral position, in which the blades extend in the travel direction of the web next to the material web, and a severing position in which the blades cross the travel path of the web.

According to another aspect of the invention, there is provided a rotationally driven camshaft including cams mounted beneath the blades, the blades being raised or lowered as a function of the rotational position of the cams.

The carrier is arranged on the side of the material web facing away from the empty reel spool.

Air blast nozzles are provided on the carrier for helping to guide the material web onto the empty reel spool. The air blast nozzles are each located between two severing elements, which may comprise blades. The blades have a straight cutting edge, or they may have a serrated cutting edge.

The winding device according to the invention comprises a winding roll, an empty reel spool on one side of the winding roll and a reel spool carrying a reel on another side of the winding roll. A severing device for severing the material web at reel spool changeover is moved into the web travel path between the winding roll and the empty reel spool. The material web is severed across the width thereof at several places sequentially by the severing device, at separation points which lie along a line that runs at an angle to the travel direction of the web. A source of pressurized air moves a new web tail created by the severing process toward the empty reel spool. The severing device comprises a rotationally driven severing roll moving from a neutral position to a cutting position and back, the severing roll having a sleeve on which several severing elements are arranged along at least one spiral line. An adjustment mechanism adjusts the rotational velocity of the severing roll to be at least approximately equal to the travel velocity of the web. The severing roll is arranged on a side of the material web facing away from the empty reel spool. Air blast nozzles provided on the severing roll guide the material web onto the empty reel spool by blowing air thereon. A pressurized air connection is provided from the interior of the severing roll to the air blast nozzles, each of said blast nozzles being located directly adjacent to a severing element. At least one air blast pipe and air blast nozzles are provided on the outer surface of the roll sleeve of the severing roll for guiding the material web onto the empty reel spool by way of blowing air thereon. A controller causes sequential rotation of the severing roll, pressurized air delivery to the blast nozzles and movement of the severing roll to its severing position. Delivery of pressurized air to the blast nozzles occurs immediately before the severing roll penetrates the material web. A controller ensures that a forwardmost severing element of each spiral line, when viewed in the rotational direction of the severing roll, is the first to act upon the material web. A supporting beam extends essentially across the width of the material web and carries the severing elements, from a neutral position to a severing position and back. The severing elements are arranged such that they engage the material web one after another when the supporting beam is moved into the severing position. The supporting beam is arranged on a side of the material web facing away from the empty reel spool.

Exemplary embodiments of the invention are depicted in the drawings and described below.

Other exemplary embodiments and advantages of the present invention may be ascertained by reviewing the present disclosure and the accompanying drawings.

BRIEF DESCRIPTION OF THE DRAWINGS

The present invention is further described in the detailed description which follows, in reference to the noted plurality of drawings by way of non-limiting exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
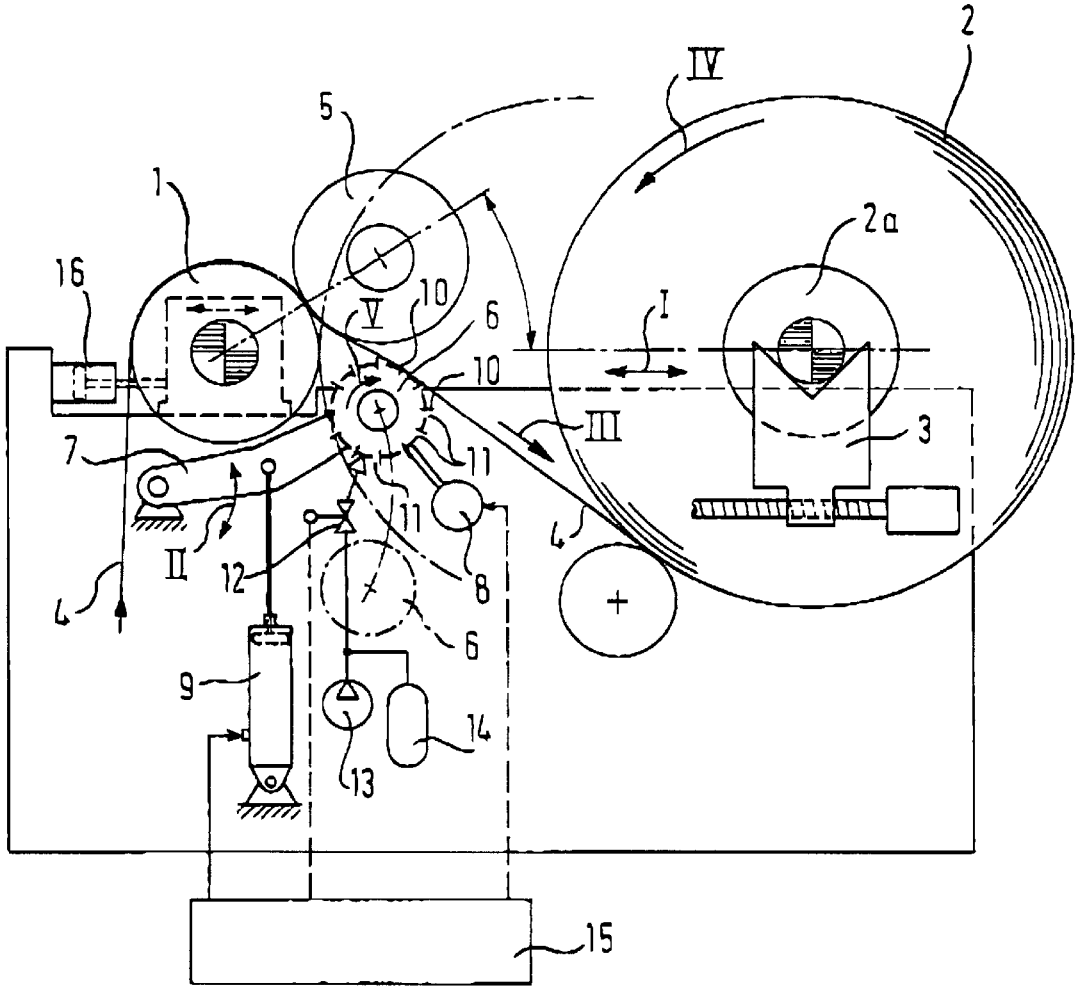
FIG. 1 is a side view of a winding device with a severing device according to the invention with severing roll.

FIG. 1 shows a winding device with a winding roll 1 and a reel spool 2*a* which is carrying a reel (wound roll) 2 formed in the device and is rotationally mounted on a winding carriage 3 that moves in the direction of the arrow I. The winding carriage 3 with the reel spool 2*a* carrying the reel 2 has already been moved to the reel spool changeover position. The normal winding position, in which the reel 2 is in contact with the winding roll 1, is indicated with a dot-and-dash line.

Above the material web 4 coming from above the winding roll 1 and leading in the direction of the reel 2, an empty reel spool 5 is placed against the winding roll 1. Located below the material web 4, and between the winding roll 1 and empty reel spool 5 on the one side, and the reel 2 on the other side, is the severing device according to the invention. It includes a severing roll 6 which is rotationally driven by a motor 8 and mounted on two swivel arms 7, of which only one is visible. By employing lift cylinders 9, the swivel arms 7 with the severing roll 6 can be swiveled along arrow II between the neutral position indicated by dot-and-dash lines and the severing position indicated by solid lines.

The outside circumference of the severing roll 6 is provided with blades 10 as severing elements and with air blast nozzles 11 in the region of the blades 10. The air blast nozzles 11 can be supplied with pressurized air through a valve 12 by a pump 13 or a storage reservoir 14. In this process, the valve 12 is controlled by a control unit 15, which at the same time controls the lift cylinder 9 and the motor 8 for rotating the severing roll 6.

Figure 2:
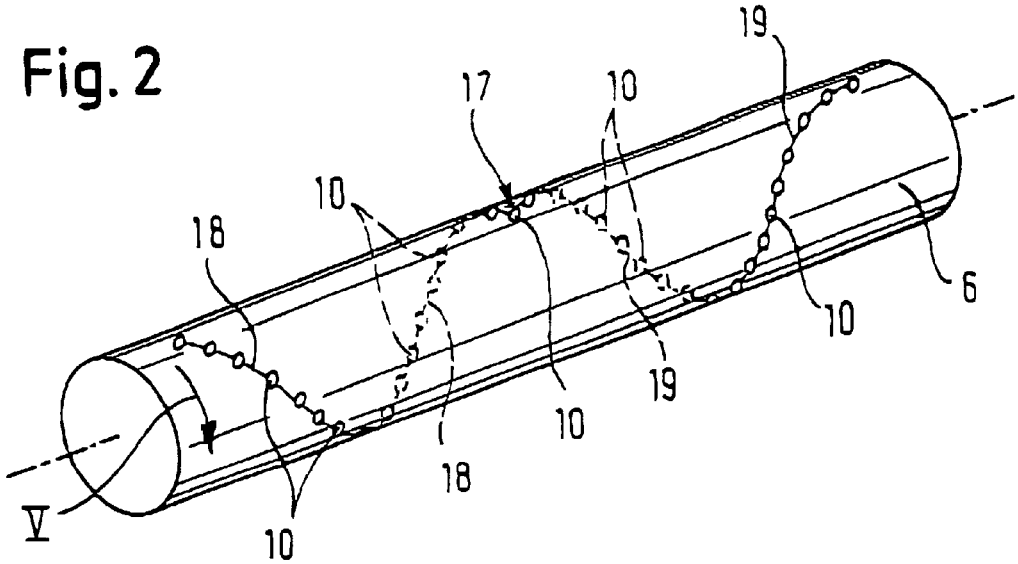
FIG. 2 is a perspective view of a severing roll that can be used in the device of FIG. 1.

In the variation shown in FIG. 2, the blades 10 on the severing roll 6 are arranged along two spiral lines 18 and 19 which process outward in opposite directions from a common point 17 in the center of the severing roll 6. In this instance, each of the spiral lines 18 and 19 encircles the severing roll 6 exactly once. However, the spiral lines 18 and 19 could also encircle the severing roll 6 less than once or more than once, thus one-and-one half times or twice, for instance. In this manner, the angle of the cut edge to the web travel direction III can be selected as desired.

Figure 3:
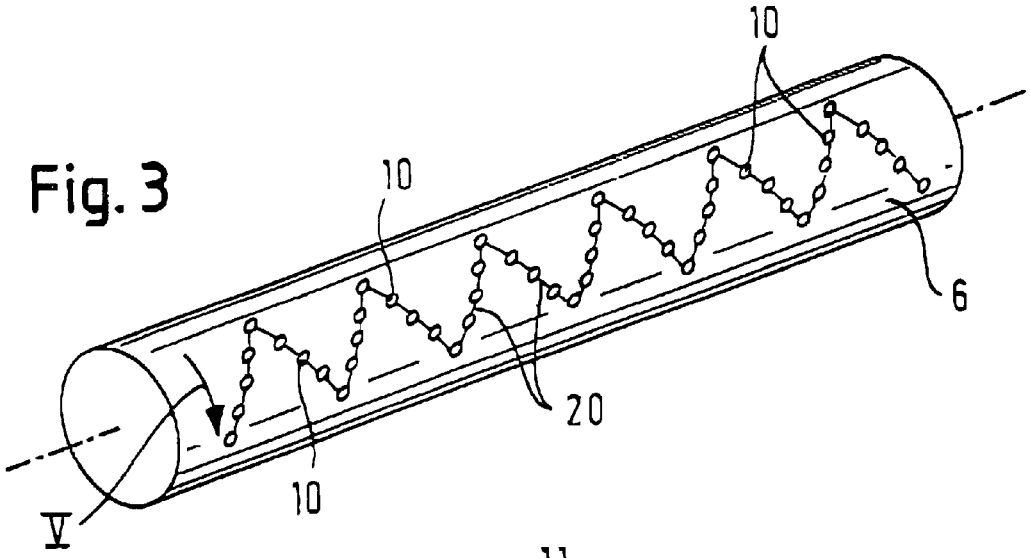
FIG. 3 is a variation of FIG. 2.

In the variation shown in FIG. 3, the blades 10 are arranged along several partial spiral lines 20. The spiral lines 20 run alternately in opposite directions and connect with one another so that a zigzag line is formed that extends across one section of the circumference of the severing roll 6 while the remaining circumference of the severing roll 6 is free of blades.

Figure 4:
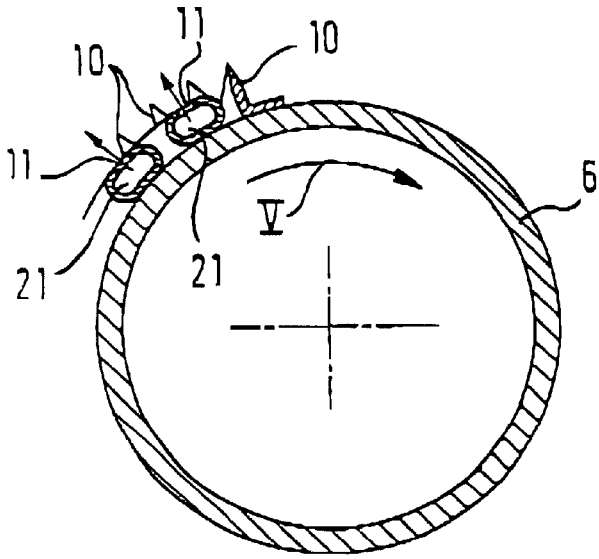
FIG. 4 is a cross-section through another variation of FIG. 2.

In the variation shown in FIG. 4, the severing roll 6 has air blast pipes 21 on its circumference which extend parallel to the blades 10, which is to say likewise in a spiral around the severing roll 6. The air blast pipes 21 are provided with air blast nozzles 11, through which the pressurized air can exit. In this way, the air blast nozzles 11 can be placed close to the blades 10 without the need to fill the entire interior of the severing roll 6 with pressurized air. This measure accelerates pressure buildup.

The material web 4 is would onto the reel spool 2*a* as shown by arrow III, which indicates the web travel direction, and arrow IV, which shows the winding direction of the reel spool 2*a*. For this purpose the winding roll 1 is pressed against the reel spool 2*a* or the reel 2 thereupon by a device 16. If the reel spool 2*a* is nearly fully wound, it is moved by the carriage 3 to the reel spool changeover position shown with solid lines. Then an empty reel spool 5 is placed on the winding roll 1 and the severing device according to the invention is activated.

To this end, the severing roll 6 is set in rotation so that its circumferential velocity is at least approximately the same as the material web velocity. Then the severing roll 6 is swung from its neutral position up into its severing position and the valve 12 is opened to blow pressurized air through the air blast nozzles 11. The act of swinging up the severing roll 6 is synchronized with the rotation of the roll such that the blades 10 on the severing roll 6 engage with the material web 4 in the desired time sequence.

In the variation shown in FIG. 2, the control system operates such that the blade 10 in the center of the severing roll 6, which is the forwardmost blades in the rotational direction of the roll 6 indicated by the arrow V, is the first to act upon the material web 4. As the roll 6 continues to rotate, the remaining blades 10 to the left and right of the roll center act on the material web 4 in sequence. Since the material web 4 continues to move at the same time, the result is a V-shaped cut edge with the peak pointing in the web travel direction III.

In the variation shown in FIG. 3, the control system can be designed such that the region of the severing roll 6, which is free of blades, is first to engage with the material web 4. Control is simplified in this way.

Figure 5:
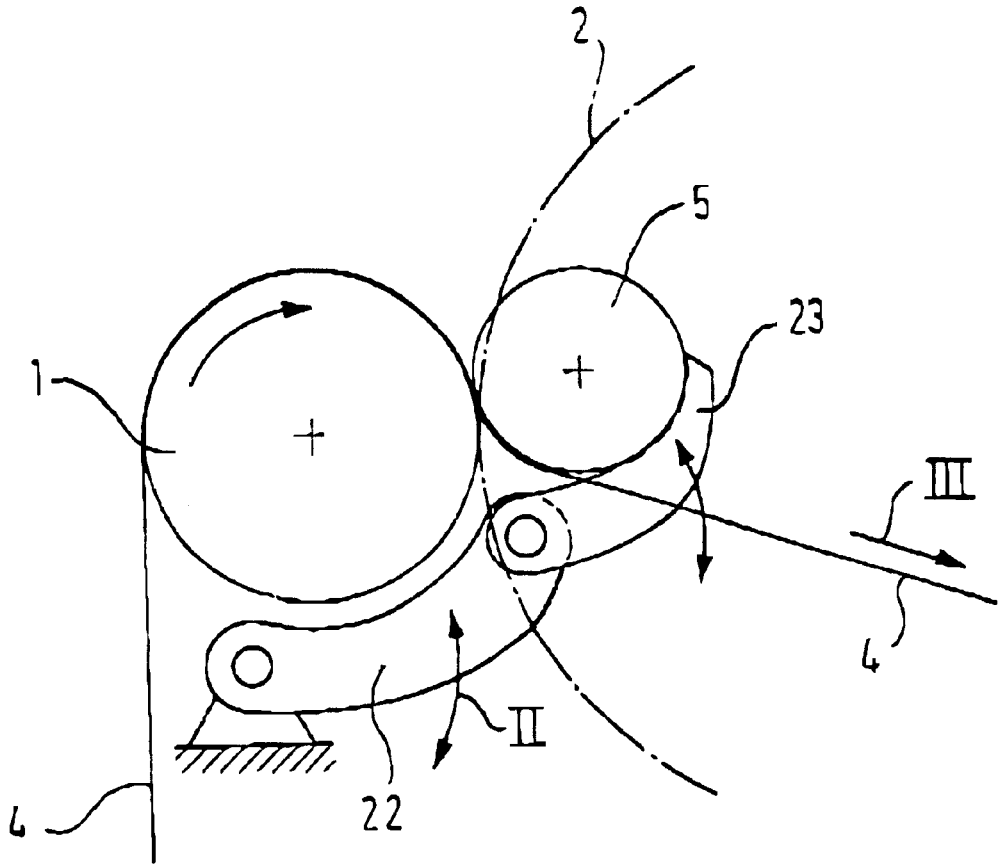
FIG. 5 is a side view of a part of a winding device with a severing device according to the invention with severing elements arranged on a supporting beam.
Figure 6:
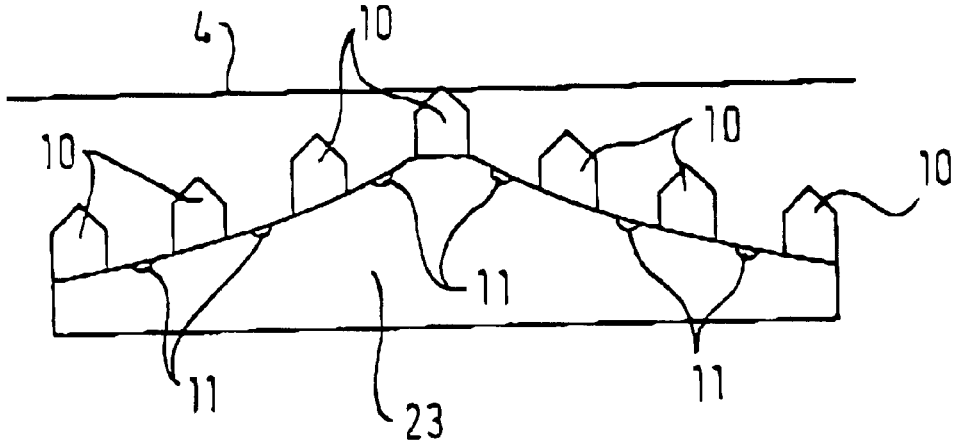
FIG. 6 is a top view of the supporting beam of FIG. 5.

FIG. 5 shows only a section of a winding device with winding roll 1 and reel 2 still in the winding position. An empty reel spool 5 already in place on the winding roll 1 is shown at the same time. Located below the winding roll 1 and the empty reel spool 5 is the severing device according to the invention. A supporting beam 23 is likewise swivel-mounted on swivel arms 22 and is provided with a plurality of blades 10 on its upper side. As can be seen especially well in FIG. 6, the blades 10 are arranged on the blade beam 23 so they are offset from one another both laterally and vertically. When the blade beam 23 is swung up, the blades 10 thus engage the material web 4 in a time sequenced manner. The simultaneous forward motion of the material web 4 thus results in a cut edge angled relative to the web travel direction III.

The device is controlled in the same way as the variation previously described in that the severing device according to the invention is swung up at reel spool changeover. Here, too, air blast nozzles 11 between the blades 10 can be supplied with compressed air when the device is swung up in order to press the newly formed web tail against the empty reel spool 5.

Figure 7:
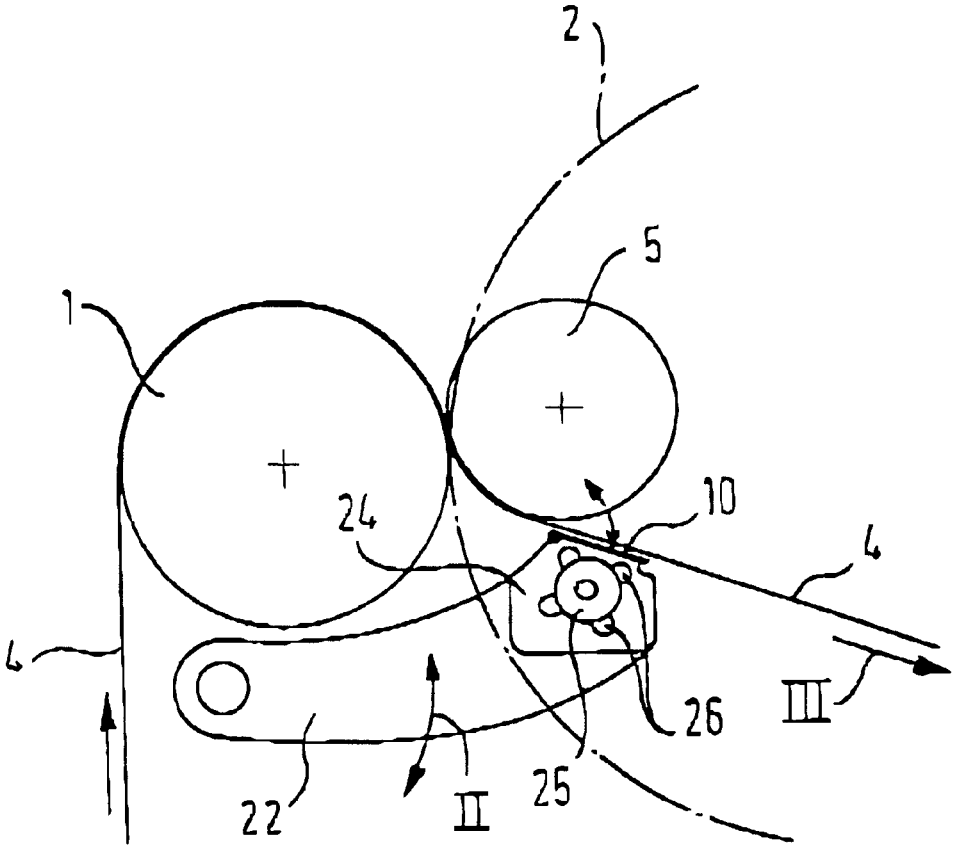
FIG. 7 is a side view of a part of a winding device with a severing device according to the invention with individual swiveling severing elements arranged on a carrier.
Figure 8:
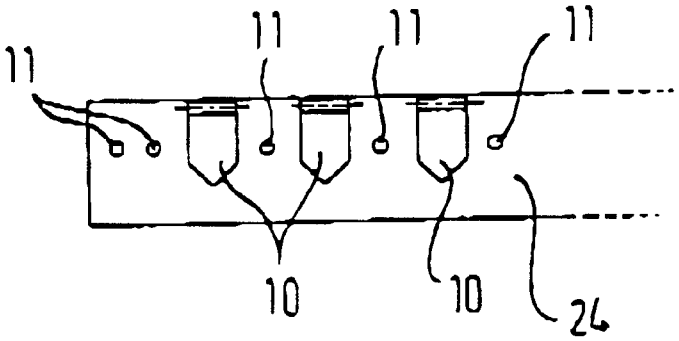
FIG. 8 is a top view of a part of the carrier of FIG. 7.

In the variation shown in FIGS. 7 and 8, a carrier 24 is attached to the swivel arms 22; the blades 10 are swivel-mounted to this carrier 24 in such a way that they can swivel between a disengaged position in which they are located beneath the material web 4 and extend parallel thereto, and an engaged position in which they extend perpendicular to the material web 4 and cross it when the swivel arms 22 are swung up. Arranged beneath the blade 10 is a camshaft 25 whose cams 26 raise or lower the blades 10 as a function of the rotational position of the camshaft 25.

After the swivel arms 22 have been swung up into the engaged position, the camshaft 25 is rotationally driven so that the cams 26 swing the blades 10 up into the web travel path of the material web 4. The cams 26 are arranged on the camshaft 25 such that the blades 10 are swung up in a time sequence that creates the desired shape in the cut edge. For example, the blade in the center of the carrier 24 can be the first to be swung up, followed by the blades 10 next to it in sequential order from inside to outside. Because the material web 4 simultaneously continues to move, a V-shaped cut edge is produced in this manner. In corresponding fashion, different desired cut edges can be created by the time-sequenced raising of the blades 10, for example, a zigzag pattern.

In this variation as well the newly formed web tail is preferably pressed against the empty reel spool 5 by pressurized air. For this purpose, it is preferred for air blast nozzles 11, which can be supplied with compressed air, to be provided on the carrier 24 between the blades 10.

Each of the blades can have a straight cutting edge or take a serrated form. For example, the serrations can have an angle of approximately 30° and be approximately 40 mm tall. The pressurized air is preferably introduced by a compressed air accumulator, which itself can be filled by a pump. In this way, the desired quantity of compressed air can quickly be made available.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

LIST OF REFERENCE CHARACTERS

1 winding roll
2 reel
2*a* reel spool
3 winding carriage
4 material web
5 empty reel spool
6 severing roll
7 swivel arm
8 motor
9 cylinder
10 blade
11 air blast nozzle
12 valve
13 pump
14 compressed air accumulator
15 control unit
16 pressure unit
17 point
18 line
19 line
20 line
21 air blast pipe
22 swivel arm
23 supporting beam
24 carrier
25 camshaft
26 cam
I direction of carriage movement
II swivel direction for 7
III web travel direction
IV winding direction for 2
V rotational direction for 6

What is claimed is:

1. A process for severing a traveling material web, at reel spool changeover, in a winding device, comprising:

moving a severing device into a web travel path between a winding roll arranged adjacent an empty reel spool and a reel spool carrying a wound roll; and severing the material web across the width of the material web at several places, the severing occurring sequentially using the severing device at separation points which lie along a line that runs at an angle to a travel direction of the material web, wherein the material web is severed after the reel spool forming the wound roll moves away from the winding roll, and wherein the severing is performed by moving a rotationally driven severing roll from a neutral position to a cutting position and back again, the rotationally driven severing roll having a sleeve on which several severing elements are arranged along at least one spiral line.

2. The process according to claim 1, further comprising:

adjusting a rotational velocity of the rotationally driven severing roll to be at least approximately equal to a travel velocity of the material web.

3. The process according to claim 1, wherein the rotationally driven severing roll is arranged on a side of the material web facing away from the empty reel spool.

4. The process according to claim 1, further comprising:

guiding the material web onto the empty reel spool by way of blowing air through air blast nozzles provided on the rotationally driven severing roll.

5. The process according to claim 4, further comprising:

supplying pressurized air from an interior of the rotationally driven severing roll to the air blast nozzles, each of said air blast nozzles being located directly adjacent to a severing element of the several severing elements.

6. The process according to claim 4, further comprising:

controlling the severing of the material web by sequentially:

rotating the rotationally driven severing roll;

delivering pressurized air to the air blast nozzles; and moving the rotationally driven severing roll to a severing position, wherein delivery of pressurized air to the air blast nozzles occurs immediately before the rotationally driven severing roll penetrates the material web.

7. The process according to claim 1, further comprising:

guiding the material web onto the empty reel spool by way of blowing air through at least one air blast pipe and air blast nozzles provided on an outer surface of the sleeve of the rotationally driven severing roll.

8. The process according to claim 7, wherein said at least one air blast pipe is arranged parallel to the severing elements along a spiral line.

9. The process according to claim 1, wherein the several severing elements are arranged along at least one spiral line which extends continuously across substantially an entire width of the rotationally driven severing roll.

10. The process according to claim 9, wherein a controller ensures that a forwardmost severing element of the at least one spiral line, when viewed in a rotational direction of the rotationally driven severing roll, is first to act upon the material web.

11. The process according to claim 1, wherein the several severing elements are arranged along two spiral lines running outwardly in opposite directions from a common point in a center of the rotationally driven severing roll.

12. The process according to claim 11, wherein the two spiral lines encircle only part of a circumference of the rotationally driven severing roll, another part of the circumference of the rotationally driven severing roll being free of the several severing elements.

13. The process according to claim 1, wherein the severing elements are arranged along several spiral lines running alternately in opposite directions and connecting with one another.

14. The process according to claim 13, wherein the spiral lines encircle only part of a circumference of the rotationally driven severing roll, another part of the circumference of the rotationally driven severing roll being free of the several severing elements.

15. The process according to claim 1, wherein said several severing elements comprise blades.

16. The process according to claim 15, wherein the blades have a straight cutting edge.

17. The process according to claim 15, wherein the blades have a serrated cutting edge.

18. A winding device for a material web, comprising:

a winding roll;

an empty reel spool arranged adjacent the winding roll;

a reel spool carrying a wound roll arranged on a side of the winding roll;

a severing device for severing the material web at reel spool changeover, said severing device being moved into a web travel path between said winding roll adjacent said empty reel spool and the wound roll, wherein the material web is severed across the width thereof at several places sequentially using the severing device at separation points which lie along a line that runs at an angle to a travel direction of the material web, wherein the material web is severed after the reel spool carrying the wound roll moves away from the winding roll, and wherein the severing device comprises a rotationally driven severing roll moving from a neutral position to a cutting position and back again, the rotationally driven severing roll having a sleeve on which several severing elements are arranged along at least one spiral line.

19. The winding device according to claim 18, further comprising:

an adjustment mechanism for adjusting a rotational velocity of the rotationally driven severing roll to be at least approximately equal to a travel velocity of the material web.

20. The winding device according to claim 18, wherein the rotationally driven severing roll is arranged on a side of the material web facing away from the empty reel spool.

21. The winding device according to claim 18, further comprising:

air blast nozzles provided on the rotationally driven severing roll for guiding the material web onto the empty reel spool by blowing air thereon.

22. The winding device according to claim 21, further comprising:

a pressurized air connection connecting an interior of the rotationally driven severing roll to the air blast nozzles, each of said air blast nozzles being located directly adjacent to a severing element of the several elements.

23. The winding device according to claim 18, further comprising:

at least one air blast pipe and air blast nozzles provided on an outer surface of the sleeve of the rotationally driven severing roll for guiding the material web onto the empty reel spool by way of blowing air thereon.

24. The winding device according to claim 23, wherein said at least one air blast pipe is arranged parallel to the several severing elements along a spiral line.

25. The winding device according to claim 18, wherein the several severing elements are arranged along at least one spiral line which extends continuously across substantially an entire width of the rotationally driven severing roll.

26. The winding device according to claim 25, wherein a controller ensures that a forwardmost severing element of the at least one spiral line, when viewed in a rotational direction of the rotationally driven severing roll, is first to act upon the material web.

27. The winding device according to claim 18, wherein the several severing elements are arranged along two spiral lines running outwardly in opposite directions from a common point in a center of the rotationally driven severing roll.

28. The winding device according to claim 27, wherein the two spiral lines encircle only part of a circumference of the rotationally driven severing roll, another part of the circumference of the rotationally driven severing roll being free of the several severing elements.

29. The winding device according to claim 18, wherein the several severing elements are arranged along several spiral lines running alternately in opposite directions and connecting with one another.

30. The winding device according to claim 29, wherein the several spiral lines encircle only part of a circumference of the rotationally driven severing roll, another part of the circumference of the rotationally driven severing roll being free of the several severing elements.

31. The winding device according to claim 18, further comprising:

a controller causing sequential rotation of the rotationally driven severing roll, causing pressurized air delivery to blast nozzles, and causing movement of the severing roll to a severing position, wherein delivery of pressurized air to the blast nozzles occurs immediately before the rotationally driven severing roll penetrates the material web.

32. A winding device for a material web, comprising:

a winding roll;

an empty reel spool arranged adjacent the winding roll;

a reel spool carrying a wound roll arranged on a side of the winding roll;

a severing device for severing the material web at reel spool changeover, said severing device being moved into a web travel path between said winding roll adjacent said empty reel spool and the wound roll, wherein the material web is severed across the width thereof at several places sequentially by the severing device, at separation points which lie along a line that runs at an angle to a travel direction of the material web;

a source of pressurized air for moving a new web tail created by the severing device toward the empty reel spool;

the severing device comprising a rotationally driven severing roll moving from a neutral position to a cutting position and back again, the rotationally driven severing roll having a sleeve on which several severing elements are arranged along at least one spiral line;

an adjustment mechanism for adjusting a rotational velocity of the rotationally driven severing roll to be at least approximately equal to a travel velocity of the material web;

the rotationally driven severing roll being arranged on a side of the material web facing away from the empty reel spool;

air blast nozzles provided on the rotationally driven severing roll for guiding the material web onto the empty reel spool by blowing air thereon;

a pressurized air connection connecting an interior of the rotationally driven severing roll to the air blast nozzles, each of said air blast nozzles being located directly adjacent to a corresponding severing element;

at least one air blast pipe and the air blast nozzles provided on an outer surface of the sleeve of the rotationally driven severing roll for guiding the material web onto the empty reel spool by way of blowing air thereon;

a controller causing sequential rotation of the rotationally driven severing roll, pressurized air delivery to the air blast nozzles and movement of the rotationally driven severing roll to a severing position, wherein delivery of pressurized air to the air blast nozzles occurs immediately before the rotationally driven severing roll penetrates the material web;

a controller for ensuring that a forwardmost severing element of the at least one spiral line, when viewed in the rotational direction of the rotationally driven severing roll, is first to act upon the material web;

a supporting beam extending essentially across the width of the material web and carrying the several severing elements, from a neutral position to a severing position and back again, wherein the several severing elements are arranged such that they engage the material web one after another when the supporting beam is moved into the severing position;

the supporting beam being arranged on a side of the material web facing away from the empty reel spool, wherein the material web is severed after the reel spool carrying the wound roll moves away from the winding roll.

* * * * *